US011719207B2

(12) United States Patent
Benson et al.

(10) Patent No.: US 11,719,207 B2
(45) Date of Patent: Aug. 8, 2023

(54) PUMP PLUNGER ASSEMBLY FOR IMPROVED PUMP EFFICIENCY

(71) Applicant: Cummins Inc., Columbus, IN (US)

(72) Inventors: Donald J. Benson, Columbus, IN (US); Bela Doszpoly, Columbus, IN (US); Eric A. Benham, Columbus, IN (US); Ahmad M. Sabri, Columbus, IN (US); Richard E. Duncan, Greenwood, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 17/778,590

(22) PCT Filed: Nov. 22, 2019

(86) PCT No.: PCT/US2019/062777

§ 371 (c)(1),
(2) Date: May 20, 2022

(87) PCT Pub. No.: WO2021/101566

PCT Pub. Date: May 27, 2021

(65) Prior Publication Data

US 2022/0412297 A1 Dec. 29, 2022

(51) Int. Cl.
*F02M 59/44* (2006.01)
*F02M 59/02* (2006.01)

(52) U.S. Cl.
CPC ..... *F02M 59/442* (2013.01); *F02M 59/02* (2013.01)

(58) Field of Classification Search
CPC ..... F02M 59/442; F02M 59/02
See application file for complete search history.

(56) References Cited

U.S. PATENT DOCUMENTS

| | | | | |
|---|---|---|---|---|
| 2,195,946 | A | 4/1940 | Uccusic | |
| 2,674,950 | A | 4/1954 | Underwood | |
| 3,053,594 | A | 9/1962 | Williamson | |
| 3,099,217 | A | 7/1963 | Bessiere | |
| 4,649,883 | A * | 3/1987 | Bohringer | F02M 59/361 123/506 |
| 4,649,887 | A * | 3/1987 | Igashira | F02M 59/105 123/495 |
| 4,831,986 | A * | 5/1989 | Linder | F02M 41/125 123/449 |
| 10,288,024 | B2 | 5/2019 | Marsden et al. | |

(Continued)

FOREIGN PATENT DOCUMENTS

| | | | |
|---|---|---|---|
| DE | 102008041176 | A1 | 2/2010 |
| JP | 2010229924 | A | 10/2010 |
| WO | 2015121010 | | 8/2015 |

OTHER PUBLICATIONS

International Search Report and Written Opinion for International patent application No. PCT/US2019/062777, filed Nov. 22, 2019, dated Feb. 10, 2020.

*Primary Examiner* — Long T Tran
(74) *Attorney, Agent, or Firm* — Taft, Stettinius & Hollister LLP

(57) ABSTRACT

A plunger is provided for reciprocating inside the barrel of a fuel pump. The plunger has a proximal end and a distal end. The proximal end of the plunger includes a cavity that defines a depressed volume within the plunger. A volume filler is disposed in the cavity, where the volume filler is constrained in the cavity by a retaining element.

18 Claims, 5 Drawing Sheets

(56) References Cited

U.S. PATENT DOCUMENTS

| | | | | |
|---|---|---|---|---|
| 2007/0221178 | A1* | 9/2007 | Feinleib | F02M 59/366 123/476 |
| 2008/0069712 | A1* | 3/2008 | Mennicken | F04B 53/1022 417/559 |
| 2008/0224417 | A1* | 9/2008 | Benson | F02M 59/02 277/411 |
| 2009/0126690 | A1* | 5/2009 | Garland | F02M 59/44 123/456 |
| 2010/0043760 | A1* | 2/2010 | Crofts | F04B 53/10 123/541 |
| 2014/0102417 | A1 | 4/2014 | Rosu et al. | |
| 2017/0058849 | A1* | 3/2017 | Marsden | F02M 61/167 |
| 2018/0017030 | A1 | 1/2018 | Laity et al. | |
| 2018/0156175 | A1* | 6/2018 | Shaull | F04B 7/0266 |
| 2019/0093616 | A1 | 3/2019 | Klein et al. | |
| 2019/0113032 | A1* | 4/2019 | Garland | F04B 1/0408 |

* cited by examiner

PUMP PLUNGER ASSEMBLY FOR IMPROVED PUMP EFFICIENCY

CROSS-REFERENCE TO RELATED APPLICATIONS

The present application is a 35 U.S.C. 371 national stage entry of International Application No. PCT/US2019/062777, filed Nov. 22, 2019, titled "PUMP PLUNGER ASSEMBLY FOR IMPROVED PUMP EFFICIENCY," the complete disclosures of which is expressly incorporation herein by reference.

FIELD OF THE DISCLOSURE

The present disclosure generally relates to fuel pumps, and more particularly to a plunger arrangement that improves pump efficiency by limiting fuel leakage.

BACKGROUND OF THE DISCLOSURE

In a high-pressure fuel pump, fuel is pressurized in a pumping chamber by the reciprocating motions of a pump plunger that moves within a bore. This results in a pumping cycle during which the volume of the pumping chamber varies. During the pressurization of the pumping chamber, some of the fuel may leak between the pump plunger and the bore through an annular clearance used for sliding and lubrication. This parasitic leakage can affect the efficiency of the pump. Accordingly, there exists a need to improve pump efficiency by minimizing the amount of parasitic leakage.

SUMMARY OF THE DISCLOSURE

According to one embodiment, the present disclosure provides a fuel pump that includes a barrel with a bore and a plunger that is movable inside the bore. The plunger has a proximal end and a distal end. The proximal end of the plunger includes a cavity which defines a depressed volume within the plunger. A volume filler is disposed in the cavity, where the volume filler is constrained in the cavity by a retaining element.

In one aspect, the proximal end of the plunger is adjacent to a pumping chamber of the fuel pump. In another aspect, the volume filler is configured to fill a majority of the depressed volume within the plunger defined by the cavity. In still another aspect, the cavity includes a bottom surface that has a curvature. As such, the volume filler includes a first end that has a shape which substantially corresponds to the curvature of the bottom surface of the cavity. The volume filler also includes a second end opposite the first end. The volume filler is constrained within the cavity by the retaining element at the second end. The retaining element may be in the form of a clip ring. In a further aspect, the volume filler includes a passage that extends along an axial length of the volume filler.

According to another embodiment, the present disclosure provides a plunger for reciprocating inside a barrel of a fuel pump. The plunger includes a proximal end and a distal end. The proximal end of the plunger has a cavity that defines a depressed volume within the plunger. A volume filler is disposed in the cavity, where the volume filler is constrained in the cavity by a retaining element.

In one aspect, the proximal end of the plunger is adjacent to a pumping chamber of the fuel pump. In another aspect, the volume filler is configured to fill a majority of the depressed volume within the plunger defined by the cavity.

In still another aspect, the cavity includes a bottom surface that has a curvature. As such, the volume filler includes a first end that has a shape which substantially corresponds to the curvature of the bottom surface of the cavity. The volume filler also includes a second end opposite the first end. The volume filler is constrained within the cavity by the retaining element at the second end. The retaining element may be in the form of a clip ring. In a further aspect, the volume filler includes a passage that extends along an axial length of the volume filler.

According to yet another embodiment, the present disclosure provides a method in a fuel pump that includes disposing a volume filler in a cavity of a plunger. The cavity defines a depressed volume within the plunger at a proximal end of the plunger. The method also includes constraining the volume filler in the cavity by a retaining element and reciprocally moving the plunger within a bore of a barrel of the fuel pump.

In one aspect, the method includes reducing, by a curved end of the volume filler, stresses induced on the plunger by the volume filler during the reciprocal movement of the plunger. The cavity also includes a curved bottom surface that substantially corresponds to the curved end of the volume filler. In another aspect, the method includes reducing, by a passage in the volume filler, pressure induced forces on the plunger by the volume filler during the reciprocal movement of the plunger. The passage extends along an axial length of the volume filler. In a further aspect, disposing the volume filler in the cavity includes completely filling the depressed volume within the plunger with the volume filler.

BRIEF DESCRIPTION OF THE DRAWINGS

The above-mentioned and other features and advantages of this disclosure, and the manner of attaining them, will become more apparent and the invention itself will be better understood by reference to the following description of embodiments of the invention taken in conjunction with the accompanying drawings, wherein.

DETAILED DESCRIPTION OF EMBODIMENTS

Figure 1:
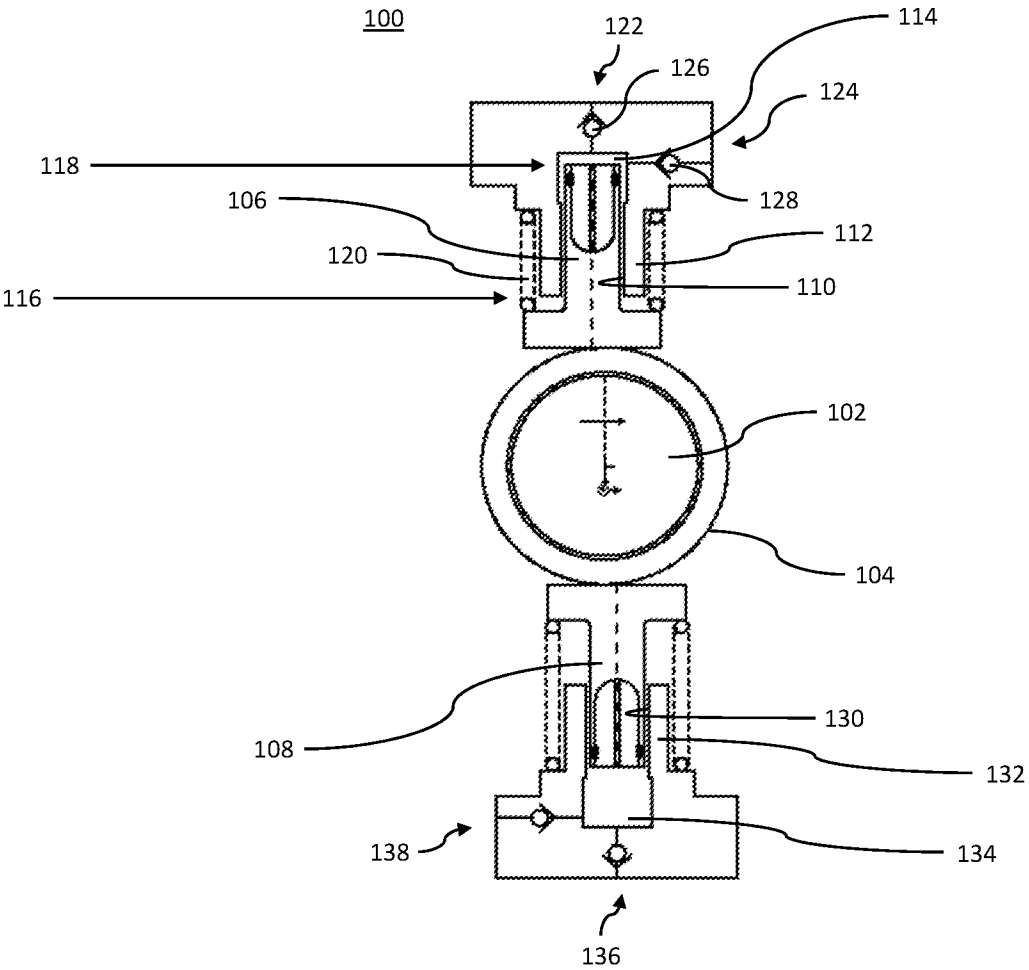
FIG. 1 is a cross-sectional view of a fuel pump.

For the purposes of promoting an understanding of the principles of the present disclosure, reference is now made to the embodiments illustrated in the drawings, which are described below. The exemplary embodiments disclosed herein are not intended to be exhaustive or to limit the disclosure to the precise form disclosed in the following detailed description. Rather, these exemplary embodiments were chosen and described so that others skilled in the art may utilize their teachings.

The terms "couples," "coupled," and variations thereof are used to include both arrangements wherein two or more components are in direct physical contact and arrangements wherein the two or more components are not in direct contact with each other (e.g., the components are "coupled" via at least a third component), but yet still cooperate or interact with each other.

Throughout the present disclosure and in the claims, numeric terminology, such as first and second, is used in reference to various components or features. Such use is not intended to denote an ordering of the components or features. Rather, numeric terminology is used to assist the reader in identifying the component or features being referenced and should not be narrowly interpreted as providing a specific order of components or features.

The present disclosure provides a plunger assembly for a fuel pump that operates to minimize fuel leakage thereby improving the efficiency of the pump. FIG. 1 shows a cross-sectional view of a high-pressure fuel pump 100. Fuel pump 100 can be used to facilitate the pumping of fuel in various applications such as pumping pressurized fuel to an internal combustion engine. While fuel pump 100 is in the form of a circular eccentric pump, other types of pumps may be contemplated in other embodiments.

Fuel pump 100 includes a cam 102 that is configured to revolve in an eccentric manner within a circular channel of a housing (not shown). Cam 102 includes a cam ring 104 that is configured to receive or coupled to respective plungers 106, 108.

Plunger 106 is disposed in a bore 110 of a barrel 112 and configured for reciprocal movement therein. Plunger 106 may be substantially but not completely disposed within bore 110 so that during reciprocal movement, at least a portion of plunger 106 extends outside of bore 110. During a pumping cycle, fuel is pressurized in a pumping chamber 114 when plunger 106 moves from a low-pressure side 116 to a high-pressure side 118. That is, a movement of plunger 106 towards high-pressure side 118 causes compression of the fuel in pumping chamber 114. This movement places plunger 106 in a retracted position. On the other hand, a movement of plunger 106 towards low-pressure side 116 (i.e., away from high-pressure side 118) causes the fuel to flow into pumping chamber 114 (e.g., if the pressure in the inlet circuit exceeds the pressure in the pumping chamber and the inlet valve is open). This movement places plunger 106 in an extended position. A pump spring 120 is fitted around barrel 112. Plunger 106 is driven in part by pump spring 1208 to reciprocate within bore 110 thereby causing plunger 106 to move between the retracted and extended positions.

Fuel enters pumping chamber 114 via an inlet 122 and exits via an outlet 124. Inlet 122 is controlled by an inlet valve 126 while outlet 124 is controlled by an outlet valve 128. In various embodiments, inlet and outlet valves 126, 128 may be any suitable active or passive check valves. In FIG. 1, outlet 124 is arranged radially relative to pumping chamber 114. In other embodiments, inlet 122 and outlet 124 may be arranged differently such as being parallel or slightly angled.

Plunger 108 operates similarly to plunger 106. That is, plunger 108 is disposed in a bore 130 of a barrel 132 and configured for reciprocal movement therein. The movement of plunger 108 within bore 132 causes fuel to be pressurized in a pumping chamber 134, with the fuel entering and exiting pumping chamber 134 via an inlet 136 and an outlet 138, respectively. In operation, the revolution of cam 102 imparts repeated reciprocating movements on plungers 106, 108. Note that in FIG. 1, plunger 106 is shown in the retracted position while plunger 108 is shown in the extended position.

Figure 3:
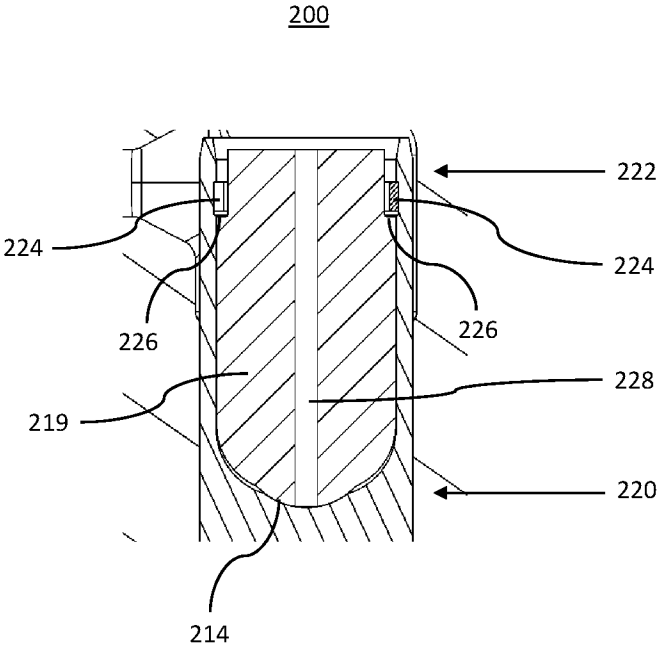
FIGS. 2-3 are enlarged cross-sectional views of a pump plunger.
Figure 2:
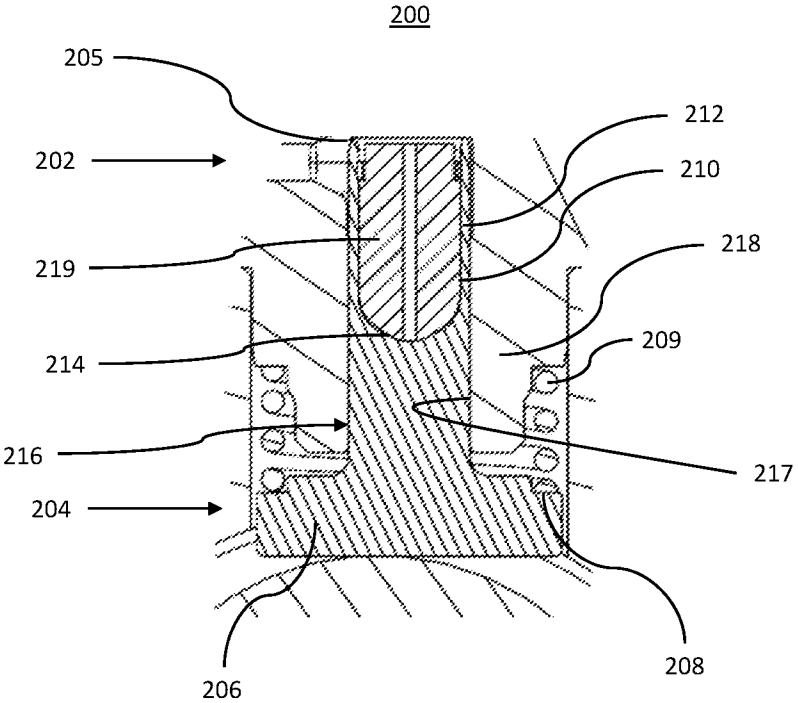

FIGS. 2 and 3 show enlarged cross-sectional views of a plunger 200, which may be similar to plunger 106 of FIG. 1. Plunger 200 includes a proximal end 202 and a distal end 204. Proximal end 202 is adjacent to a pumping chamber 205. Distal end 204 includes a plunger foot 206 with a spring seat 208. A pump spring 209 is coupled to plunger 200 via spring seat 208. Proximal end 202 includes a cavity 210 which defines a depressed volume within plunger 200.

Cavity 210 is limited by a peripheral wall 212 and a bottom surface 214. The purpose of cavity 210 is to minimize parasitic leakage, which occurs when fuel leaks through an annular clearance or gap 216 that exists between plunger 200 and a bore 217. In particular, as plunger 200 approaches pumping chamber 205, pressure rises and causes peripheral wall 212 to expand radially outward to close, at least partially, annular clearance 216. This in turn reduces the amount of leaked fuel between plunger 200 and bore 217.

Bottom surface 214 of cavity 210 has a curvature that acts to reduce stress concentrations on plunger 200. The curvature also functions to improve the durability of plunger 200, which in turn allows plunger 200 to operate at higher pressure limits. The curvature may have a single large radius or be comprised of multiple smaller radiuses that form a larger radius as shown in FIG. 3. The depth or length of cavity 210 is dependent on the length of a barrel 218. Ideally, the length of cavity 210 is such that it does not interfere with the freedom of the axial motion of plunger 200 at full stroke.

A volume filler 219 is disposed in cavity 210 and configured to fill the depressed volume within plunger 200. For example, to fill a majority of the depressed volume (e.g., 95%). Volume filler 219 has a first end 220 and a second end 222. First end 220 has a protruding curved shape that generally or substantially corresponds to the curvature of bottom surface 214. Second end 222 is opposite first end 220 and is commensurate with proximal end 202 of plunger 200. Volume filler 219 may be made from any suitable metal, although other materials such as ceramic or polymer may also be considered.

Volume filler 219 is secured or constrained within cavity 210 by a retainer or retaining element 224 at second end 222. Second end 222 has a groove 226 which holds retaining element 224. Retaining element 224 in groove 226 presses against the inner surface of peripheral wall 212 at the groove in order to secure volume filler 219 in place. In this manner, retaining element 224 acts to limit any movement of volume filler 219 in cavity 210. Retaining element 224 also allows volume filler 219 to be used independent of the plunger orientation. For example, if plunger 200 was arranged in an upside-down orientation as shown by plunger 108 in FIG. 1, then without retaining element 224, volume filler 219 would be free to move and not remain in cavity 210 due to gravity induced forces.

Preferably, retaining element 224 should act to axially retain volume filler 219 without applying any or any excessive forces which would act to create a radial distortion on the outer diameter of plunger 200 along the annular clearance 216 between plunger 200 and bore 217. Further, any gap between the outer surface of volume filler 219 and inner surface of peripheral wall 212 should be minimized. Thus, it is beneficial to design the dimensions so that there is no radial interference that would affect annular clearance 216 between plunger 200 and bore 217.

Volume filler 219 may also include a passage 228 that extends along an axial length of volume filler 219. Passage 228 provides a flow passage that acts to minimize the pressure differential between the two ends (e.g., 220, 222) of volume filler 219. This in turn reduces pressure induced by axial forces acting on plunger 200 by volume filler 219 Passage 228 is located at approximately the center of volume filler 219. The volume of passage 228 is minimized while enabling passage 228 to serve as a means to limit the pressure differential between the two ends of plunger 200. This location helps to minimize any net force that passage 228 may act on retaining element 224.

Figure 4:
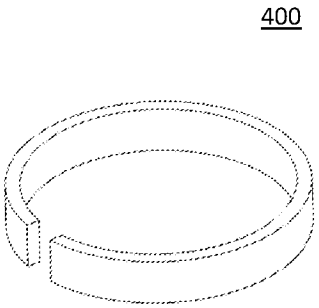
FIG. 4 is a perspective view of a retaining element for the pump plunger.

FIG. 4 shows a perspective view of a retaining element 400. Retaining element 400 may be an embodiment of retainer 224. In this example, retaining element 400 is in the form of a C-shaped clip ring. During the assembly of plunger 200, volume filler 219 is inserted into cavity 210. Clip ring 400 is then radially deformed in groove 226. When clip ring 400 passes the required axial distance consistent with groove 226, the radial compressive force on clip ring 400 is removed to allow clip ring 400 to elastically expand to its undeformed state. Clip ring 400 remains in groove 226 because the outer diameter of clip ring 400 is greater than the inner diameter of peripheral wall 212. While FIG. 4 shows a clip ring type retainer, other suitable retaining mechanisms may be contemplated in other embodiments.

Figure 6:
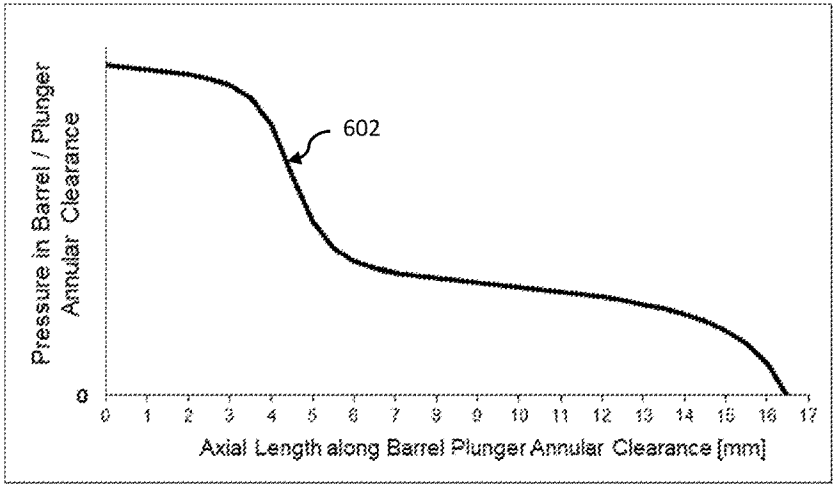
FIG. 6 is a graph illustrating predicted pressure distributions for pump plunger.
Figure 5:
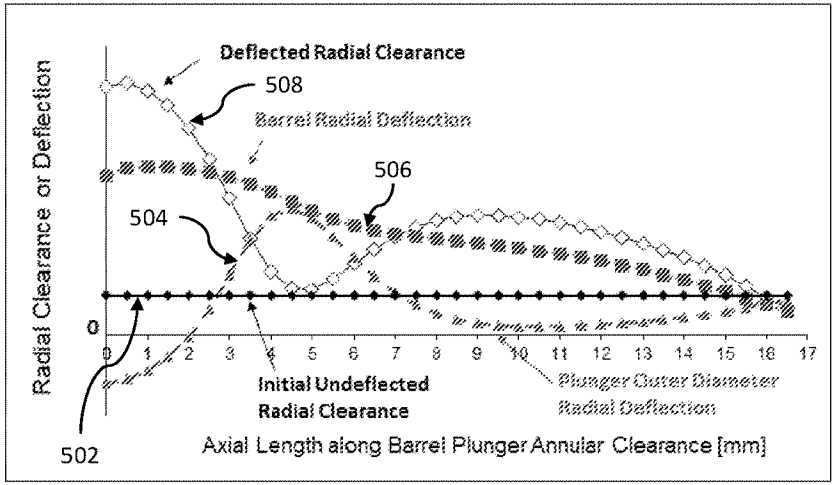
FIG. 5 is a graph illustrating predicted geometrical deformations for the pump plunger.

FIGS. 5 and 6 show graphs that illustrate the analytically predicted geometrical deformations and pressure distributions for plunger 200. In FIG. 5, various curves can be seen including: (i) a curve 502 showing the initial un-deflected radial clearance between plunger 200 and bore 217 (or barrel 218), (ii) a curve 504 showing the radial deflection of the outer diameter of plunger 200, (iii) a curve 506 showing the radial deflection of bore 217, and (iv) a curve 508 showing the resulting radial clearance between plunger 200 and bore 217 that includes the deflection of both the plunger and barrel.

The parasitic leakage rate is reduced relative to a standard pump configuration mainly due to the radially outward deformation of the plunger as a result of the pressure differential between the high pressures acting on the inner surface of the cavity in the plunger and the lower pressures acting on the outer surface of the plunger. For the operating condition shown in FIG. 5, the maximum outward radial deflection of the plunger occurs near a 4.5 mm along the plunger/barrel annular clearance length.

In FIG. 6, a curve 602 shows the pressure distributions along the plunger/barrel annual clearance length. There is a significant pressure drop produced by the reduction in the deflected radial clearance near the zone where the maximum outward radial deflection of the plunger occurs. This reduced radial clearance significantly reduces the parasitic leakage rate which in turn improves pump efficiency.

Figure 7:
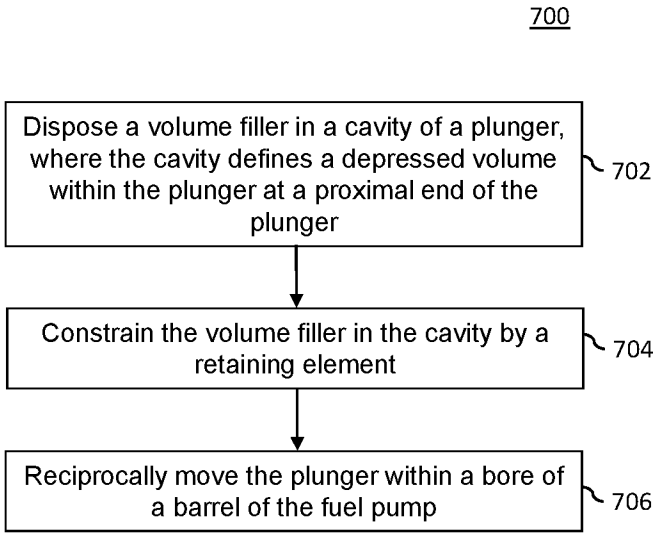
FIG. 7 is a flow chart illustrating a method of operating the pump plunger.

FIG. 7 shows a flow chart of a method 700 in a fuel pump (e.g., 100). At block 702, a plunger (e.g., 106, 200) is assembled by disposing a volume filler (e.g., 219) in a cavity (e.g., 210) of the plunger. The cavity defines a depressed volume within the plunger at a proximal end of the plunger. The disposed volume filler completely fills the depressed volume within the plunger. At block 704, the volume filler is constrained in the cavity by a retaining element (e.g., 224). The retaining element may be in the form of a clip ring. At block 706, the assembled plunger is operated in the fuel pump by reciprocally moving the plunger within a bore of a barrel of the fuel pump.

The volume filler may have a curved end that acts to reduce stresses induced on the plunger by the volume filler during the reciprocal movement of the plunger. As such, the cavity has a curved bottom surface that generally or substantially corresponds to the curved end of the volume filler. The volume filler may also have a passage that acts to reduce axial forces induced on the plunger by the volume filler during the reciprocal movement of the plunger. The passage extends along an axial length of the volume filler.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements. The scope is accordingly to be limited by nothing other than the appended claims, in which reference to an element in the singular is not intended to mean "one and only one" unless explicitly so stated, but rather "one or more."

Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B or C may be present in a single embodiment; for example, A and B, A and C, B and C, or A and B and C.

Systems, methods and apparatus are provided herein. In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic with the benefit of this disclosure in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A fuel pump comprising:

a barrel including a bore;

a plunger movable inside the bore, the plunger having a proximal end and a distal end, the proximal end including a cavity that defines a depressed volume within the plunger; and a volume filler disposed in the cavity, the volume filler being constrained in the cavity by a retaining element, wherein the volume filler includes a passage that extends along an entire axial length of the volume filler.

2. The fuel pump of claim 1, wherein the proximal end is adjacent to a pumping chamber of the fuel pump.

3. The fuel pump of claim 1, wherein the volume filler is configured to fill a majority of the depressed volume within the plunger defined by the cavity.

4. The fuel pump of claim 1, wherein the cavity includes a bottom surface having a curvature.

5. The fuel pump of claim 4, wherein the volume filler includes a first end having a shape that substantially corresponds to the curvature of the bottom surface of the cavity.

6. The fuel pump of claim 5, wherein the volume filler includes a second end opposite the first end, wherein the retaining element constrains the volume filler within the cavity at the second end.

7. The fuel pump of claim 6, wherein the retaining element is a clip ring.

8. A plunger comprising:

a proximal end and a distal end, the proximal end having a cavity that defines a depressed volume within the plunger; and a volume filler disposed in the cavity, the volume filler being constrained in the cavity by a retaining element;

wherein the plunger is configured to reciprocate inside a barrel of a fuel pump and the volume filler includes a passage that extends along an entire axial length of the volume filler.

9. The plunger of claim 8, wherein the proximal end is adjacent to a pumping chamber of the fuel pump.

10. The plunger of claim 8, wherein the volume filler is configured to fill a majority of the depressed volume within the plunger defined by the cavity.

11. The plunger of claim 8, wherein the cavity includes a bottom surface having a curvature.

12. The plunger of claim 11, wherein the volume filler includes a first end having a shape that substantially corresponds to the curvature of the bottom surface of the cavity.

13. The plunger of claim 12, wherein the volume filler includes a second end opposite the first end, wherein the retaining element constrains the volume filler within the cavity at the second end.

14. The plunger of claim 13, wherein the retaining element is a clip ring.

15. A method in a fuel pump comprising:

disposing a volume filler in a cavity of a plunger, the cavity defining a depressed volume within the plunger at a proximal end of the plunger, wherein the volume filler includes a passage that extends along an entire axial length of the volume filler:

constraining the volume filler in the cavity by a retaining element; and reciprocally moving the plunger within a bore of a barrel of the fuel pump.

16. The method of claim 15, further comprising reducing, by a curved end of the volume filler, stresses induced on the plunger by the volume filler during reciprocal movement of the plunger, wherein the cavity includes a curved bottom surface that substantially corresponds to the curved end of the volume filler.

17. The method of claim 15, further comprising reducing, by the passage in the volume filler, pressure induced forces on the plunger by the volume filler during reciprocal movement of the plunger.

18. The method of claim 15, wherein disposing the volume filler in the cavity includes completely filling the depressed volume within the plunger with the volume filler.

* * * * *